US005337291A

United States Patent [19]

Huang et al.

[11] Patent Number: 5,337,291

[45] Date of Patent: Aug. 9, 1994

[54] EASY SETTING HOUR REPEATING DEVICE

[76] Inventors: Ghin-Yuan Huang, 2/F, No. 351, Hwa-Chen Road, Hsin-Chuang City; Ting-Chen Chang, No. 4, Lane 255, Sec. 3, Yang-Hu Rd., Yang-Mei Town, Tou-Yuan, both of Taiwan

[21] Appl. No.: 151,014

[22] Filed: Nov. 12, 1993

[51] Int. Cl.[5] ..... G04B 19/00; G04B 21/02

[52] U.S. Cl. ..... 368/75; 264/267; 264/269

[58] Field of Search ..... 368/72–75, 368/243–244, 252–254, 246, 248, 267, 268, 269

[56] References Cited

U.S. PATENT DOCUMENTS

| | | |
|---|---|---|
| 1,556,184 | 10/1925 | Volpo . |
| 2,163,419 | 6/1939 | Warren . |
| 3,524,314 | 8/1970 | Morton et al. . |
| 3,715,879 | 2/1973 | Cielaszyk . |
| 3,930,360 | 1/1976 | Boyles . |

*Primary Examiner*—Vit W. Miska
*Attorney, Agent, or Firm*—Bacon & Thomas

[57] ABSTRACT

An easy setting hour repeating device comprising mainly of a transmission shaft, a slot (or flange), a minute wheel, a cam claw, a short spring and a long spring, wherein the slot is provided at the side edge of the hand assembly section on the top of the transmission shaft which is protrusively extended on the dial from the minute wheel, and the position of the slot forms a certain included angle with the cam claw under the wheel, when the minute wheel moves, the cam claw will contact the alarm spring first, then release the spring to make the spring activate the electric circuit of the alarm clock, the slot are aligned with the dial index 12, during assembly, it requires only the slot, minute hand and the dial index 12 be aligned to make the alarm clock repeat on the hour to achieve the easy hands assembly purpose.

1 Claim, 3 Drawing Sheets

EASY SETTING HOUR REPEATING DEVICE

BACKGROUND OF THE INVENTION

1. Field of Invention:

The present invention relates to an easy setting hour repeating device comprising mainly of a transmission shaft, a slot (or flange), a minute wheel, a cam claw, a short spring and a long spring, wherein the slot is provided at the side edge of the hand assembly section on the top of the transmission shaft protrusively extended on the dial from the minute wheel, and the position of the slot forms a certain included angle with the cam claw under the wheel, when the slot, minute hand and the dial index 12 are aligned during assembly, the alarm clock can repeat on the hour. The principle of action of a repeater is to provide a cam claw on the bottom of the minute wheel inside the alarm clock movement and to provide a short spring and a long spring outside the cam claw, when the minute wheel moves up to the cam claw and touches the long spring, the long spring will be held, after the minute wheel moves further to an action point, the long spring will be released and bent forward by means of the spring force to touch the short spring for connecting the electric circuit to make the alarm clock repeat the time, therefore, for on hour repeat, the minute hand must be aligned with the dial index 12.

2. Description of the Prior Art:

The manufacturing flow chart of an alarm clock is to manufacture the clock movement, the dial and the hands etc. components respectively, then assemble such components. Therefore, before the clock movements are delivered to the clock assembler, the minute wheels of these movements should be fixed on the above-mentioned action point, the following two troubles will be incurred during the manufacture of movements and the assembly of alarm clocks:

1. Before delivery, the movement must be tested and fixed by instruments and turn the minute wheel to the position where the two springs are contacted for circuit connection and fit it, the adjustment procedure is very complicated, therefore, the production cost is increased and uneconomical;

2. When the movement is delivered to the assembly factory to fit the dial and hands, the wheel mechanism of the movement will be easily touched incidentally, as a result, the minute wheel will be deflected and makes an alarm clock unable to repeat the time correctly, and the movement must be disassembled, assembled and adjusted again. It makes the assembly inconvenient and even affect the production speed. In view of the said problems, an easy setting hour repeating device of the present invention is thus created to provide easy assembly convenience, during assembly of the dial and hands, whether the wheel is deflected or not, once the above-mentioned slot, minute hand and the dial 12 are aligned, the alarm clock can make accurate repeating on hour, so as to simplify the hands setting procedure and to increase the production capacity.

SUMMARY OF THE INVENTION

The main object of the present invention is to provide an easy setting hour repeating device, wherein a slot is provided at the side edge of the hand assembly section on the top of the transmission shaft protrusively extended on the dial from the minute wheel, and the position of the slot forms a certain included angle with the cam claw under the wheel, and the slot, transmission shaft, the minute wheel and the cam claw is integral injection molded, it requires only to calculate their positions when design the mold, so that the movements before delivery will be unnecessary to make test and positioning to reduce the production cost.

Another object of the present invention is to provide an easy setting hour repeating device to provide easy assembly convenience, during assembly of the dial and hands, whether the wheel is deflected or not, once the above-mentioned slot, minute hand and the dial 12 are aligned, the alarm clock can make accurate repeating on hour, so as to simplify the hands setting procedure and to increase the production capacity.

DESCRIPTION OF THE PREFERRED EMBODIMENT

Figure 1:
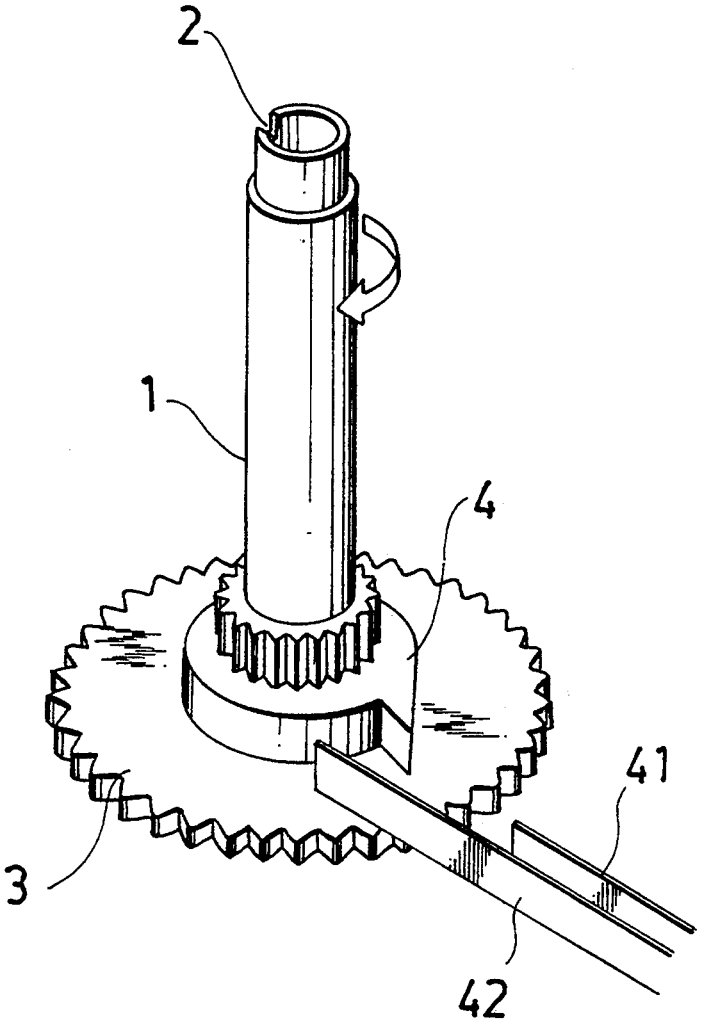
FIG. 1 is a perspective exploded view of the preferred embodiment of the present invention.
Figure 2:
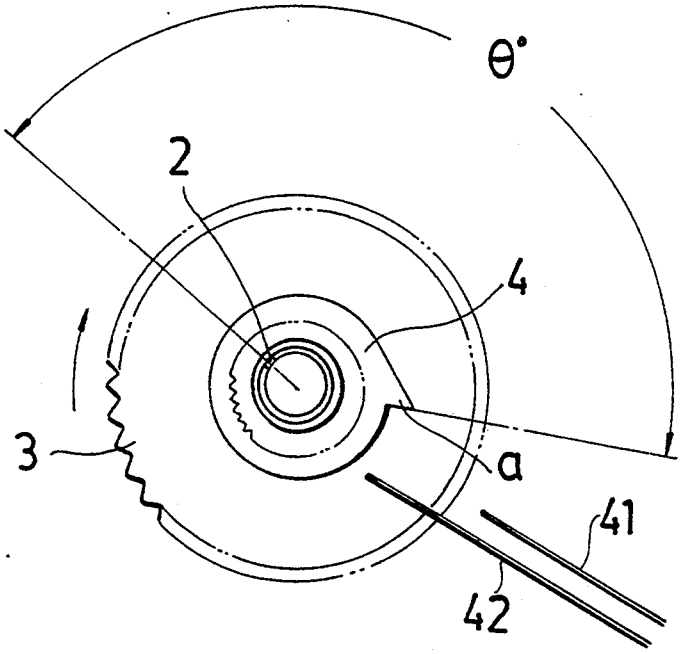
FIG. 2 is a schematic view showing the cam claw is in the inactivated position.
Figure 3:
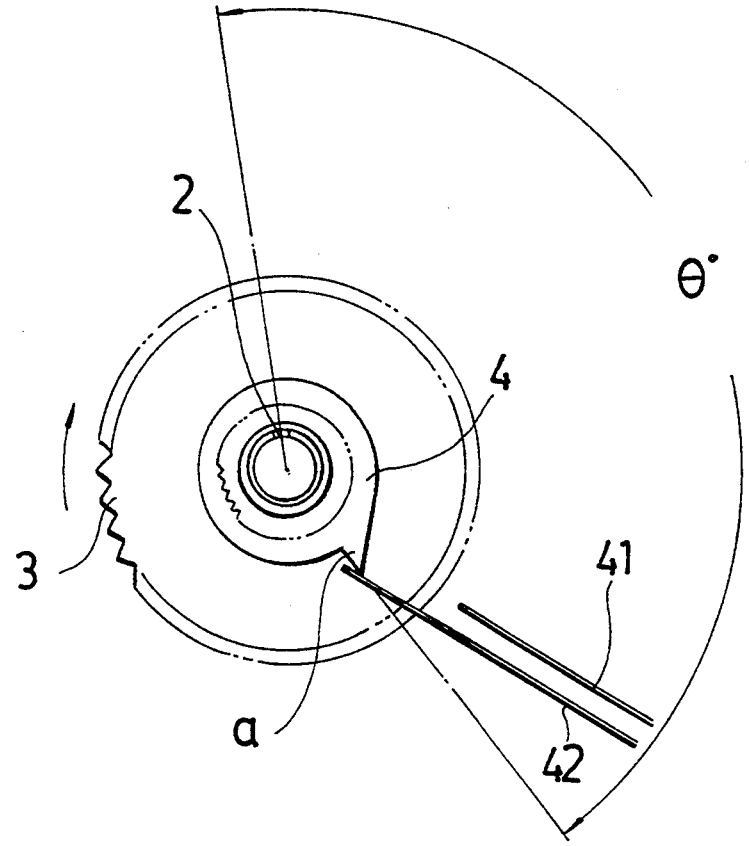
FIG. 3 is a schematic view showing the cam claw is touching the long spring.
Figure 4:
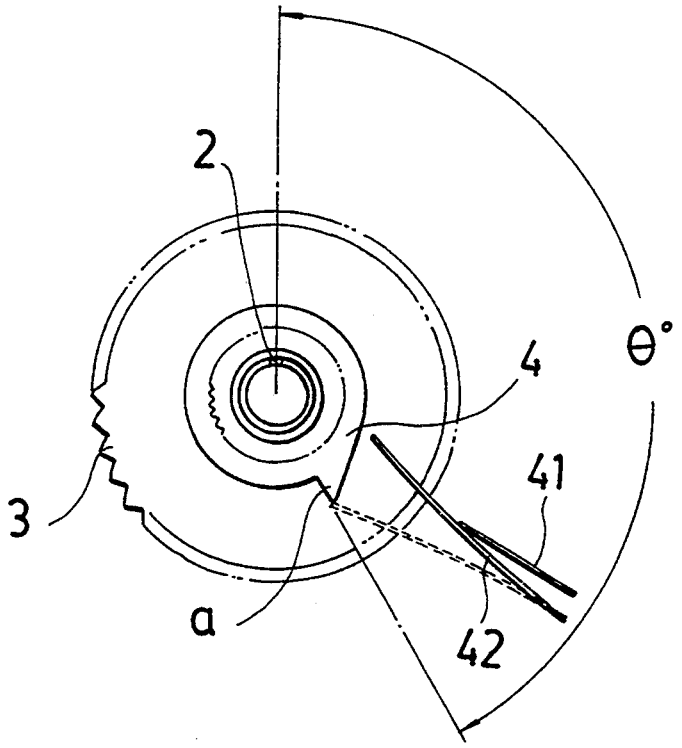
FIG. 4 is a schematic view showing the long spring and short spring is connected.

Referring to FIG. 1, an easy setting hour repeating device comprising mainly of a transmission shaft (1), a slot (or flange) (2), a minute wheel (3), a cam claw (4), a short spring (41) and a long spring (42), wherein the slot (2) is provided at the side edge of the hand assembly section on the top of the transmission shaft (1), the minute wheel (3) is coaxially extended on the bottom of the said transmission shaft (1), the cam claw (4) is provided on the bottom of the minute wheel (3), and a short spring (41) and a long spring (42) are provided outside the cam claw (4); when the minute wheel (3) moves to certain position (please refer to FIG. 2 and 3), the cam claw (4) can touch the long spring (42) and make the long spring (42) bend and move, after the cam claw (4) moves further to an action point (a) (as illustrated in FIG. 4), the long spring (42) can be released from the support of the cam claw (4) and be sprung away in reverse direction, and be sprung back to touch the short spring (41) and make the electric circuit on rear ends of the two springs (41, 42) be connected (not illustrated) to activate alarm clock to repeat the time; the above-mentioned slot (2) and cam claw (4) should be positioned in such a way that when the cam claw (4) moves to the action point (a), the slot (2) must be aligned with the dial index 12 (not illustrated), so that a certain included angle ($\theta$) will be formed between the slot (2) and the cam claw (4); during assembly, if the minute hand (not illustrated) and the slot (2) are aligned, after the minute hand reaches the dial 12, the on-hour time can be repeated.

When the alarm clock movement containing the above-mentioned device is completed, it should be sent to a fitting factory for further assembly. In case of any deflection of the slot due to vibration during the transportation or incidental human touch, it will not affect the assembly job, irrespective the slot is deflected to any position, one requires only to assemble the minute hand according to the above-mentioned method to achieve the easy assembly purpose.

We claim:

1. An easy setting hour repeating device for a clock mechanism comprising:

a) a transmission shaft;

b) a minute wheel located on and affixed to the transmission shaft;

c) a cam affixed to the transmission shaft and having a cam claw extending therefrom;

d) a minute hand positioning slot defined by the transmission shaft angularly displaced a predetermined angle from the cam claw;

e) a first contact;

f) a second, resilient contact normally out of contact with the first contact, the second contact located so as to be engaged and resiliently displaced by the cam claw as the transmission shaft rotates whereby the cam claw disengages from the second contact when the minute hand positioning slot is in a predetermined position, the resiliency of the second contact being such that it comes into contact with the first contact after disengagement from the cam claw.

* * * * *